United States Patent [19]

Warby

[11] Patent Number: 4,744,495

[45] Date of Patent: May 17, 1988

[54] VALVE FOR PRESSURIZED DISPENSING CONTAINERS

[75] Inventor: Richard J. Warby, King's Lynn, England

[73] Assignee: Bespak PLC, King's Lynn, England

[21] Appl. No.: 828,379

[22] Filed: Feb. 11, 1986

[30] Foreign Application Priority Data

Feb. 12, 1985 [GB] United Kingdom ..... 8503553

[51] Int. Cl.[4] ..... B65D 83/14

[52] U.S. Cl. ..... 222/402.16; 222/402.2; 222/402.24

[58] Field of Search ..... 222/402.2, 402.16, 402.24; 137/353, 354

[56] References Cited

U.S. PATENT DOCUMENTS

| | | | |
|---|---|---|---|
| 2,858,053 | 10/1958 | Waldherr | 222/402.2 |
| 3,135,437 | 6/1964 | Gorman | 222/402.24 X |
| 3,319,669 | 5/1967 | Abplanalp | 141/20 |
| 3,813,013 | 5/1974 | Kotuby et al. | 222/402.2 |
| 4,413,755 | 11/1983 | Brunet | 222/402.2 |

FOREIGN PATENT DOCUMENTS

| | | |
|---|---|---|
| 390458 | 8/1965 | Switzerland . |
| 1201918 | 8/1970 | United Kingdom . |
| 1280229 | 7/1972 | United Kingdom . |
| 1287126 | 8/1972 | United Kingdom . |

*Primary Examiner*—Charles A. Marmor

*Attorney, Agent, or Firm*—Beveridge, DeGrandi & Weilacher

[57] ABSTRACT

A valve (10) for dispensing metered doses from a pressurized dispensing container (17) has a valve cup (13) attached to the container. A valve housing (11) fixed to the valve cup has within it nested components (30, 31) the inner one of which defines a metering chamber (16). A valve stem (12) slides through seals (14, 15) one of which is trapped between the valve cup (13) and the inner nested component (30). The other seal (15) is trapped between the nested components. The valve stem is urged into an inoperative position by a spring (60) located within the valve housing but outside the metering chamber. The inner and outer nested components have unequal numbers of castellations (41, 42) formed in their edges around the valve stem to permit flexing of the seal (15) during filling of the container.

10 Claims, 2 Drawing Sheets

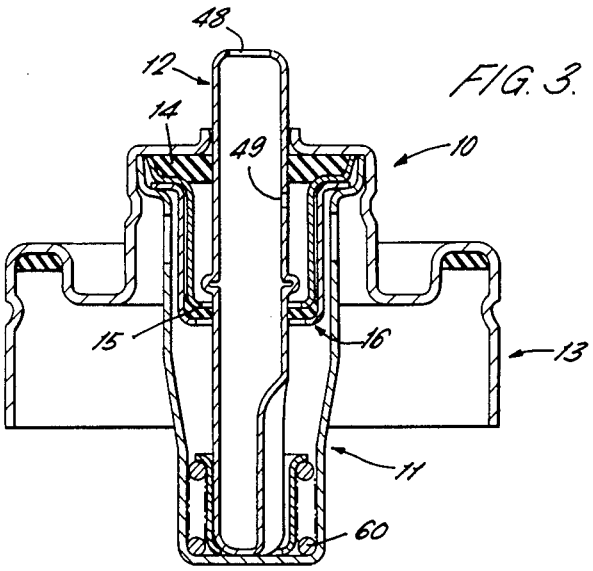
FIG. 3.
FIG. 4.
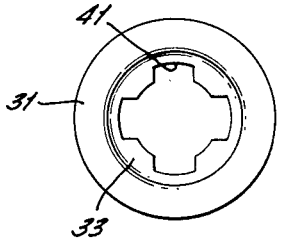
FIG. 5.
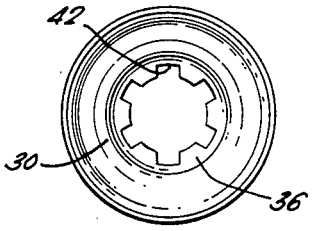

VALVE FOR PRESSURIZED DISPENSING CONTAINERS

The invention relates to valves for pressurised dispensing containers and more particularly to valves for dispensing metered doses from a pressurised dispensing container.

Known metering valves for pressurised dispensing containers usually have a metering chamber within the valve, the metering chamber having seals at its upper and lower end and being filled with a fresh dose of product to be dispensed immediately after the previous dose has been dispensed. A valve stem slides through the seals and is movable between an inoperative position where the metering chamber is filled with product to be dispensed and an operative position in which the metered dose of product is dispensed through the valve stem. The valve stem is spring urged into its inoperative position. In the past, the metering chamber has usually been defined by a component within a housing of the valve and the usual practice has been to locate the spring inside the metering chamber. This has tended to detract from the provision of accurately metered doses from the valve and there has generally been no provision for allowing different predetermined sizes of metering chamber within the valve.

The invention provides a valve for dispensing metered doses from a pressurised dispensing container and comprising a valve housing, a metering chamber within the valve housing, first and second valve seals closing off opposed ends of the metering chamber and a valve stem in sliding engagement with aperture in the seals and extending therethrough, the valve stem including an outlet orifice and an inlet orifice which communicates with the metering chamber when the valve stem is in an operative position, the valve stem being spring urged into an inoperative position, in which the spring is located within the valve housing outside the metering chamber and in which the metering chamber comprises inner and outer nested components, one of the valve seals being trapped between said nested components and the inner component defining the volume of the metering chamber.

Preferably, portions of said nested components between which said valve seal is trapped include cut-away portions adjacent the aperture through which the valve stem extends, said cut-away portions being arranged to facilitate flexing the valve seal, to allow ingress of pressurised medium past the valve seal to the valve housing.

The cutaway portions may comprise castellations, a different number of castellations being formed in said inner and outer nested components. In one embodiment, there are six castellations on the inner components and four on the outer component.

Preferably there is a spring retaining cup fitting over the inner end of the valve stem within the housing the spring being located between a portion of said cup and an end wall of the valve housing.

In a preferred embodiment, all the components of the valve except said first and second seals are of metal. This is particularly important in certain applications where the valve is intended to dispense pharmaceutical products which might be affected by deterioration of plastics components within the valve.

Preferably the valve further comprises a valve cup for attaching the valve to a container. The particular type of valve cup will be determined by the container to which the valve is to be attached.

The invention also provides a pressurised dispensing containg including a valve as described above.

A preferred embodiment of the invention will now be described, by way of example, with reference to the accompanying drawings, in which:

FIG. 3 is a view similar to FIGS. 1 and 2 but with the valve stem fully depressed to an operative position;

FIG. 4 is a plan view of a component of the metering chamber of the valve of FIG. 1, and, FIG. 5 is a plan view of another component of the metering chamber of the valve of FIG. 1.

Figure 1:
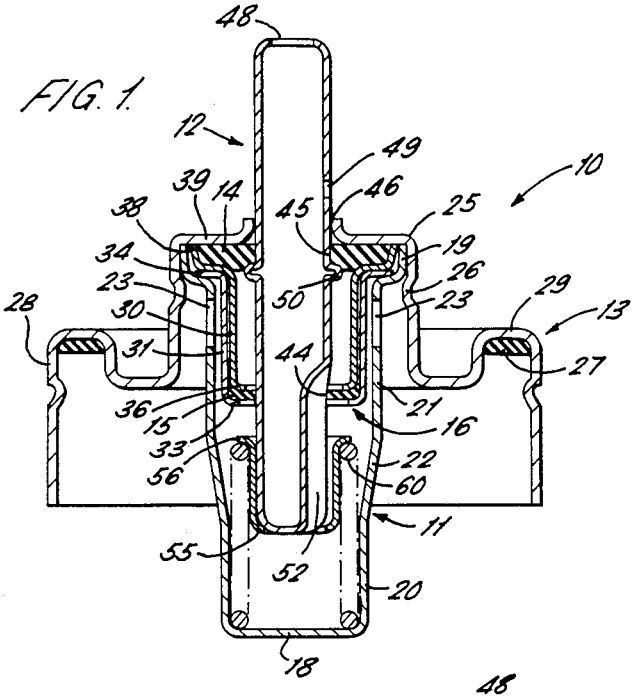
FIG. 1 is a section through a metering valve according to the invention with its valve stem in a first, inoperative, position.

Referring first to FIG. 1, a metering valve 10 for an aerosol container comprises the following main components:

A valve housing 11, a valve stem 12, a valve cup 13, first and second seals 14, 15 and a metering chamber 16.

The valve housing 11 is of generally cylindrical configuration, closed at one end 18 and having an enlarged diameter portion 19 at its other, open, end which provides a seat for the metering chamber 16. Between the ends 18 and 19 of the valve housing 11, the housing comprises first and second cylindrical portions 20, 21 of differing diameter, these sections being joined by a frusto-conical portion 22. Orifices 23 formed in the cylindrical portion 21 adjacent the end portion 19 provide communication between the interior of the valve housing 11 and an aerosol container (not shown) to which the valve is attached, in use. The open end 19 of the valve housing fits within a central cylindrical portion 25 of the valve cup 13 and is retained in position by an annular indentation 26 in the valve cup.

As can be seen in the drawings, the valve cup 13 comprises a second cylindrical portion 28 of considerably greater diameter than the portion 25, the two cylindrical portions being joined by a radially extending portion 29 of generally S shaped cross-section. The exact shape of the portions 28, 29 of the valve cup will depend on the container to which the valve is to be attached. The configuration shown in the drawings is typical for attachment to an ordinary aerosol container but different configurations may be provided if the valve is to be attached to a bottle or a roll neck container. The valve cup 13 is attached to the aerosol container or bottle in known conventional manner, a gasket 27 being provided to form a seal between the valve cup 13 and the container.

The metering chamber 16 is located within the valve housing 11 and co-axial therewith. The metering chamber 16 is formed from two components, inner and outer chamber components 30, 31 respectively. The outer chamber component 31 is a cylindrical member having an inturned portion 33 at one end and an outwardly turned annular flange 34 at the other end. The inner chamber portion 30 has an inwardly turned end 36 adjacent to end 33 of chamber portion 31 and, at its other end, an outwardly and upwardly turned portion 38. The portion 38 of chamber component 30 provides a seating for the first seal 14 which is clamped between the annular shoulder defined by the portion 38 and the upper end 39 of the valve cup. The chamber component 31 fits around the chamber component 30 as shown in FIGS. 1 to 3 and is retained in assembled, nested, relation therewith by its portion 34 being clamped between the underside of portion 38 of chamber component 30 and the annular shoulder defined by portion 19 of the valve cup 11. The second seal 15 of the valve is located between portions 33 and 36 of chamber components 31 and 30 respectively.

As can be seen more clearly in FIGS. 4 and 5, portions 33 and 36 of chamber components 31, 30 are provided with castellations. In the particular embodiment shown, portion 33 has four castelletions 41 while portion 36 has six castelletions 42. Although the number of castelletions provided in portion 33, 36 is not critical, the number of castelletions in the two portions should differ. The castelletions are provided for a purpose to be described below.

It will be appreciated that the size of the metering chamber is defined by chamber component 30. The size of the chamber may therefore be varied by altering the shape of component 30. Consequential alteration of the shape of component 31 will then also be required so that the components 30, 31 still fit together in nested relation. It will be appreciated that altering the size and shape of the sub-assembly of components 30,31 need not affect the other components in the valve or the assembly of the valve. In order to provide metering chambers of different size, the central portion of chamber component 30 may include a reduced diameter portion or its length may be altered while the end portions 36, 38 of chamber component 30 remain unaltered. At extremes of size, the necessary alteration of chamber component 30 may require consequential minor alterations to other parts of the valve. For example, with very short components 30 the valve stem may require modification and for very large metering chambers, the valve body 11 may be of a larger diameter.

Figure 2:
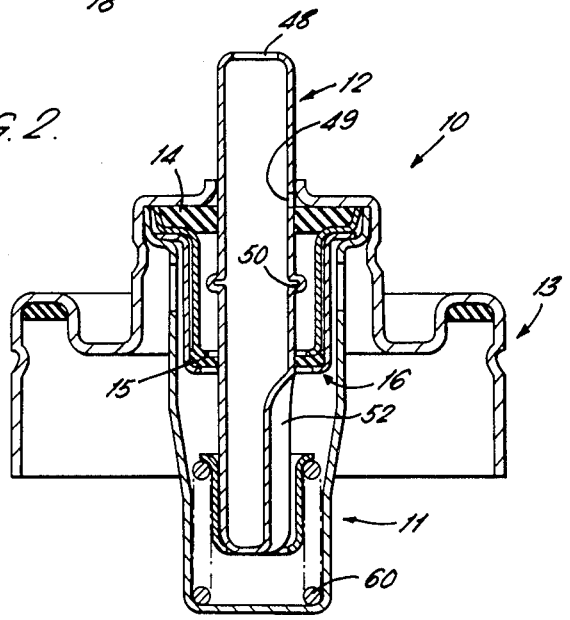
FIG. 2 is a view similar to FIG. 1 but with the valve stem partially depressed to a second position.

As can be seen in FIGS. 1 to 3, the assembled metering chamber components and seal 15 have a central aperture 44 provided therein and aligned apertures 45, 46 are provided in the first seal 14 and the upper end 39 of the valve cup 13.

The valve stem 12 is a sliding fit in these apertures. The valve stem 12 is a hollow generally cylindrical tube having an outlet orifice 48 at its upper end and an inlet aperture 49 formed in its side wall at the position shown in the drawings. The valve stem includes an enlarged diameter portion 50 which, in the position shown in FIG. 1, seats on the first seal 14 and thereby defines the upper most position of the valve stem. The lower end of the valve stem is closed and includes an inverted wall portion 52 which extends from the lower end of the valve stem for approximately one third of its length to a position above the seal 15 when the valve is in its inoperative position shown in FIG. 1. The inverted wall portion 52 defines a channel extending axially along the valve stem. The length of this channel may vary as the length of chamber component 30 is varied.

A cup shaped member 55 fits around the lower end of the valve stem 12 and includes an outwardly turned portion 56 defining an annular shoulder which provides a seating for one end of a spring 60. The spring 60 urges the valve stem into its inoperative position as shown in FIG. 1 and the other end of the spring 60 seats on the lower end wall of the valve housing 11.

With the exception of the first and second seals 14, 15 which are of a known rubber compound, and the gasket 27 which is also usually rubber, all the components of the valve 10 are formed from metal. In one example, the valve cup 13, and spring retaining cup 55 are of aluminium while the remaining components of the valve are of stainless steel. The provision of a metering valve which does not include any plastics components has advantages in applications where deterioration of the plastics components within the valve might result from the material being dispensed from the aerosol container to which the valve is attached. This is particularly important in some pharmaceutical applications.

The operation of the valve 10 is as follows. The valve is designed for use in an inverted position. In the description of the components of the valve above, references have been made to upper and lower ends of components and this describes the valve in the position shown in FIGS. 1 to 3 which is its normal upright position when it is attached to a can or bottle and that can or bottle is standing upright. This is the usual rest position. However, the valve is inverted in use, that is rotated through 180° from the position shown in FIGS. 1 to 3.

Referring now to FIG. 1 which shows the valve in its inoperative position and imagining the valve to be inverted, it will be appreciated that the contents of the container to which the valve is attached, that is the product to be dispensed, will flow through apertures 23 to fill the valve housing 11. The product will also flow via passage 52 into the metering chamber 16 and thereby fill the metering chamber. In the position shown in FIG. 1, the product will not be released from the metering chamber because the first valve seal 14 is in sealing contact around the valve stem 12, and abutting the enlarged diameter portion 50.

When it is desired to dispense a metered dose of produce through the valve 10, the valve stem 12 is depressed (that is moved downwardly with respect to the position shown in FIG. 1) until the valve stem reaches the position shown in FIG. 2 relative to the other components of the valve. In the position shown in FIG. 2, the valve stem has reached a position where the passage 52 is no longer providing a flow path between the interior of the metering chamber 16 and the interior of the remainder of valve housing 11. As shown in FIG. 2, the passage 52 is now below the second valve seal 15 which is now in sealing contact with the valve stem thereby isolating the remaining interior of metering chamber from the valve housing 11. However, in the position shown in FIG. 2, the metered dose of product which is now contained in the metering chamber 16 has not yet started to be dispensed because the inlet aperture 49 to the valve stem 12 is still above the first valve seal 14 which is still in sealing contact around the valve stem. In the position shown in FIG. 2 therefore, a metered dose of product is contained in the metering chamber which is now isolated.

Upon further depression of the valve stem, the stem moves to the position shown in FIG. 3 relative to the other components of the valve. In this position, the valve stem is still in sealing contact with the lower valve seal 15 so that no product may enter the metering chamber 16. However, the inlet aperture 49 has now passed through the upper valve seal 14 so that the metering chamber is in communication with the interior of the valve stem and thence with the outlet aperture 48 from the valve stem. The metered dose of product contained in the metering chamber thereby passes out through the valve stem to be dispensed.

When the valve stem is released, the spring 60 returns the valve stem from the position shown in FIG. 3 to the position shown in FIG. 2 where the inlet aperture 49 is again closed off and thence to the position shown in FIG. 1 where the metering chamber 16 is again in communication with the interior of the valve housing 11 and is thereby refilled with the product to be dispensed.

The operation of the valve as described above is the normal sequence of operation when the valve is attached to an aerosol container which is filled with product to be dispensed, the product being under pressure. It is usual for the valve to be attached to a container which is empty, the container then being filled with the product and pressure medium. The valve 10 is designed to facilitate such a filling operation. It is usual for such a filling operation to be conducted by placing a filling head over the valve. The filling head depresses the valve stem and forces product and pressure medium through and around the valve stem and thence into the metering chamber. The castellations 41, 42 formed in the components 30, 31 of the metering chamber are so arranged that, during this filling operation, they allow the second valve seal 15 to deflect thereby allowing product and pressure medium to pass through the seal 15 and thence through the valve housing 11 and into the container to which the valve is attached. It will be appreciated that the differing number of castellations in the two chamber components 30, 31 ensures that the castellations will never all be axially aligned so that an adequate seating for the second valve seal 15 is provided while still allowing adequate deflection of the valve seal during the filling operation.

The invention is not limited to the embodiment described above and various modifications may be made. For example, although the valve described is intended for use in an inverted position, a similar valve may be provided for upright operation. In this case, the apertures 23 will not be provided in the valve housing 11 which instead will have an inlet aperture at its lower end and a dip tube connected to that inlet aperture will extend to a position adjacent the bottom of the container to which the valve is attached.

Furthermore as described above, the size of the metering chamber may be predetermined by substituting for the chamber components 30, 31 alternative appropriately shaped components.

Still further, the castellations formed on the chamber components 30,31 may be replaced by cut-outs of different shape around the periphery of the central aperture of those components.

I claim:

1. A valve for dispensing metered doses from a pressurized dispensing container, said valve comprising:

a valve housing;

an outer nested component located within the housing, an inner nested component nestably located within the outer nested component, and defining a metering chamber therein, first and second valve seals having apertures, the valve seals closing off opposed ends of the metering chamber, a valve stem in sliding engagement with the apertures in the seals and extending therethrough, the valve stem having an outlet orifice and an inlet orifice, the inlet orifice communicating with the metering chamber when the valve stem is in an operative position, and a spring for urging the valve stem into an inoperative position, the spring located within the valve housing outside the metering chamber, wherein one of the valve seals is trapped between said nested components and the inner component defines the volume of the metering chamber.

2. A valve as claimed in claim 1 in which portions of said nested components between which said valve seal is trapped include cut-away portions adjacent the aperture through which the valve stem extends, said cut-away portions being arranged to facilitate flexing the valve seal, to allow ingress of pressurized medium past the valve seal to the valve housing.

3. A valve as claimed in claim 1 in which a spring retaining cup fits over the inner end of the valve stem within the valve housing, the spring being located between a portion of said cup and an end wall of the valve housing.

4. A valve as claimed in claim 1 in which all the components of the valve except said first and second seals are of metal.

5. A valve as claimed in claim 1 further comprising a valve cup for attaching the valve to a container.

6. A valve as claimed in claim 5 in which said inner and outer nested components locate in a seat formed in the valve housing and the valve housing is attached to the valve cup thereby to retain the valve components in assembled relation.

7. A valve as claimed in claim 6 in which the other valve seal is located between a seat formed in said inner nested component and a wall portion of the valve cup.

8. A pressurized dispensing container including a valve as claimed in claim 1.

9. A valve for dispensing metered doses from a pressurized dispensing container, said valve comprising:

a valve housing, an outer nested component located within the housing, an inner nested component nestably located within the outer nested component and defining a metering chamber therein, first and second valve seals having apertures, the valve seals closing off opposed ends of the metering chamber, a valve stem in sliding engagement with the apertures in the seals and extending therethrough, the valve stem having an inlet orifice and an outlet orifice, the inlet orifice communicating with the metering chamber when the valve stem is in an operative position, and a spring for urging the valve stem into an inoperative position, the spring being located within the valve housing outside the metering chamber, the inner nested component defining the volume of the metering chamber, portions of the nested components trapping one of said valve seals therebetween, said portions having cut-away portions, said cut-away portions comprising castellations adjacent the aperture through which the valve stem extends, said castellations being arranged to facilitate flexing of the valve seal to allow ingress of pressurized medium passed through the valve seal to the valve housing, the inner and outer nested components each having a different number of castellations formed therein.

10. A valve as claimed in claim 9 in which the inner component has six castellations and the outer component has four castellations.

* * * * *